US006328783B1

(12) United States Patent
Bates

(10) Patent No.: US 6,328,783 B1
(45) Date of Patent: Dec. 11, 2001

(54) PRODUCING IRON FROM SOLID IRON CARBIDE

(75) Inventor: Cecil Peter Bates, Mt. Pleasant (AU)

(73) Assignee: Technological Resources PTY LTD, Melbourne (AU)

( * ) Notice: Subject to any disclaimer, the term of this patent is extended or adjusted under 35 U.S.C. 154(b) by 0 days.

(21) Appl. No.: 09/331,272

(22) PCT Filed: Dec. 17, 1997

(86) PCT No.: PCT/AU97/00853

§ 371 Date: Aug. 12, 1999

§ 102(e) Date: Aug. 12, 1999

(87) PCT Pub. No.: WO98/27232

PCT Pub. Date: Jun. 25, 1998

(30) Foreign Application Priority Data

Dec. 18, 1996 (AU) ..... PO 4263

(51) Int. Cl.[7] ..... C21B 11/00
(52) U.S. Cl. ..... 75/501; 75/566; 420/29
(58) Field of Search ..... 75/500, 501, 502, 75/566; 423/439; 420/29

(56) References Cited

U.S. PATENT DOCUMENTS

| | | |
|---|---|---|
| Re. 33,464 | 11/1990 | Gitman . |
| 2,647,045 | 7/1953 | Rummel . |
| 3,844,770 | 10/1974 | Nixon . |
| 3,845,190 | 10/1974 | Yosim et al. . |
| 3,888,194 | 6/1975 | Kishigami et al. . |
| 3,890,908 | 6/1975 | von Klenck et al. . |
| 3,894,497 | 7/1975 | Helke et al. . |
| 4,007,034 | 2/1977 | Hartwig et al. . |
| 4,083,715 | 4/1978 | Langhammer . |
| 4,145,396 | 3/1979 | Grantham . |
| 4,177,063 | 12/1979 | Dickson . |

FOREIGN PATENT DOCUMENTS

| | | |
|---|---|---|
| A-23864/84 | 1/1984 | (AU) . |
| B-41064/85 | 4/1986 | (AU) . |
| B-69707/87 | 9/1987 | (AU) . |
| B-22448/88 | 5/1989 | (AU) . |
| B-26831/88 | 7/1989 | (AU) . |

(List continued on next page.)

OTHER PUBLICATIONS

Patent Abstract of Japan, JP, A, 10–280020 (Nippon Steel Corp.), Oct. 20, 1998.
Patent Abstracts of Japan, C–951, p. 24, JP, A, 04–63218 (Kawasaki Heavy Ind. Ltd), Feb. 28, 1992.
Patent Abstracts of Japan, C–627, p. 109, Jp, A, 01–127613 (Kawasaki Steel Corp.), May 19, 1989.
WPAT print–out for Brazilian patent application PI9400123–5 (Weber) Sep. 26, 1995.
Patent Abstracts of Japan, C–951, JP, A, 4–63217 (Kawasaki Heavy Ind. Ltd.), Feb. 28, 1992.
Patent abstracts of Japan, C–497, p. 115, JP, A, 62–280315 (Nippon Kokan K.K), Dec. 15, 1987.
Derwent Abstract Accession No. 87–039748/06 Class Q77, JP, A, 61–295334, Dec. 26, 1986.

*Primary Examiner*—Melvyn Andrews

(57) ABSTRACT

A method of producing iron from iron carbide is disclosed. Solid iron carbide is injected into a molten bath comprising molten iron and slag and dissolves in the molten bath. An oxygen-containing gas is injected into a gas space above the surface of the molten bath to cause combustion of at least a portion of combustible material in the gas space. In addition splashes and/or droplets of molten iron and/or slag are ejected upwardly from the molten bath into the gas space above the quiescent bath surface to form a transition zone. The transition zone is a region in which heat generated by combustion of combustible material is transferred to the splashes and/or droplets of molten iron and/or slag and thereafter is transferred to the molten bath when the splashes and/or droplets of molten iron and/or slag return to the molten bath.

20 Claims, 1 Drawing Sheet

U.S. PATENT DOCUMENTS

| | | |
|---|---|---|
| 4,207,060 | 6/1980 | Zangs . |
| 4,356,035 | 10/1982 | Brotzmann et al. . |
| 4,389,043 | 6/1983 | Weber et al. . |
| 4,400,936 | 8/1983 | Evans . |
| 4,402,274 | 9/1983 | Meenan et al. . |
| 4,431,612 | 2/1984 | Bell et al. . |
| 4,447,262 | 5/1984 | Gay et al. . |
| 4,455,017 | 6/1984 | Wunsche . |
| 4,468,298 | 8/1984 | Byrne et al. . |
| 4,468,299 | 8/1984 | Byrne et al. . |
| 4,468,300 | 8/1984 | Byrne et al. . |
| 4,481,891 | 11/1984 | Takeshita et al. . |
| 4,504,043 | 3/1985 | Yamaoka et al. . |
| 4,511,396 | 4/1985 | Nixon . |
| 4,521,890 | 6/1985 | Burnham et al. . |
| 4,565,574 | 1/1986 | Katayama et al. . |
| 4,566,904 | 1/1986 | von Bogdandy et al. . |
| 4,572,482 | 2/1986 | Bedell . |
| 4,574,714 | 3/1986 | Bach et al. . |
| 4,602,574 | 7/1986 | Bach et al. . |
| 4,664,618 | 5/1987 | Gitman . |
| 4,681,599 | 7/1987 | Obkircher . |
| 4,684,448 | 8/1987 | Itoh et al. . |
| 4,701,214 | 10/1987 | Kaneko et al. . |
| 4,718,643 | 1/1988 | Gitman . |
| 4,786,321 | 11/1988 | Hoster et al. . |
| 4,790,516 | 12/1988 | Sugiura et al. . |
| 4,798,624 | 1/1989 | Brotzmann et al. . |
| 4,804,408 | 2/1989 | Fuhringer et al. . |
| 4,836,847 | 6/1989 | Bishop et al. . |
| 4,849,015 | 7/1989 | Fassbinder et al. . |
| 4,861,368 | 8/1989 | Brotzmann et al. . |
| 4,874,427 | 10/1989 | Hamada et al. . |
| 4,890,562 | 1/1990 | Gitman . |
| 4,913,734 | 4/1990 | Romenets et al. . |
| 4,923,391 | 5/1990 | Gitman . |
| 4,940,488 | 7/1990 | Maeda et al. . |
| 4,946,498 | 8/1990 | Weber . |
| 4,976,776 | 12/1990 | Elvander et al. . |
| 4,999,097 | 3/1991 | Sadoway . |
| 5,005,493 | 4/1991 | Gitman . |
| 5,024,737 | 6/1991 | Claus et al. . |
| 5,037,608 | 8/1991 | Tarcy et al. . |
| 5,042,964 | 8/1991 | Gitman . |
| 5,050,848 | 9/1991 | Hardie et al. . |
| 5,051,127 | 9/1991 | Hardie et al. . |
| 5,065,985 | 11/1991 | Takahashi et al. . |
| 5,177,304 | 1/1993 | Nagel . |
| 5,191,154 | 3/1993 | Nagel . |
| 5,222,448 | 6/1993 | Morgenthaler et al. . |
| 5,238,646 | 8/1993 | Tarcy et al. . |
| 5,271,341 | 12/1993 | Wagner . |
| 5,279,715 | 1/1994 | La Camera et al. . |
| 5,301,620 | 4/1994 | Nagel et al. . |
| 5,302,184 | 4/1994 | Batterham et al. . |
| 5,322,547 | 6/1994 | Nagel et al. . |
| 5,332,199 | 7/1994 | Knapp et al. . |
| 5,333,558 | 8/1994 | Lees, Jr. . |
| 5,396,850 | 3/1995 | Conochie et al. . |
| 5,401,295 | 3/1995 | Brotzmann . |
| 5,407,461 | 4/1995 | Hardie et al. . |
| 5,415,742 | 5/1995 | La Camera et al. . |
| 5,443,572 | 8/1995 | Wilkison et al. . |
| 5,489,325 | 2/1996 | Keogh et al. . |
| 5,498,277 | 3/1996 | Floyd et al. . |
| 5,518,523 | 5/1996 | Brotzmann . |
| 5,529,599 | 6/1996 | Calderon . |
| 5,613,997 | 3/1997 | Satchell, Jr. . |
| 5,630,862 | 5/1997 | Greenwalt . |
| 5,640,708 | 6/1997 | Conochie et al. . |
| 5,647,888 | 7/1997 | Keogh et al. . |
| 5,683,489 | 11/1997 | Hayashi et al. . |
| 5,741,349 | 4/1998 | Hubble et al. . |
| 5,800,592 | 9/1998 | den Hartog et al. . |
| 5,802,097 | 9/1998 | Gensini et al. . |
| 5,869,018 * | 2/1999 | Stephens, Jr. ..... 423/439 |
| 5,871,560 | 2/1999 | Fluch et al. . |
| 5,938,815 | 8/1999 | Satchell, Jr. . |
| 6,083,296 | 7/2000 | Innes et al. . |
| 6,143,054 | 11/2000 | Dry . |
| B1 4,940,488 | 8/1999 | Maeda et al. . |

FOREIGN PATENT DOCUMENTS

| | | |
|---|---|---|
| B-28802/89 | 8/1989 | (AU) . |
| A-42859/89 | 4/1990 | (AU) . |
| A-49307/90 | 9/1990 | (AU) . |
| A-49309.90 | 9/1990 | (AU) . |
| B-74840/91 | 10/1991 | (AU) . |
| B-90957/91 | 8/1992 | (AU) . |
| A-48938/93 | 4/1994 | (AU) . |
| B-48937/93 | 5/1994 | (AU) . |
| B-50820/96 | 1/1997 | (AU) . |
| 3139375 | 4/1983 | (DE) . |
| 3244744 | 5/1984 | (DE) . |
| 079 182 A1 | 5/1983 | (EP) . |
| 084 288 A1 | 7/1983 | (EP) . |
| 422 309 A1 | 4/1991 | (EP) . |
| 541 269 A1 | 5/1993 | (EP) . |
| 592 830 A1 | 4/1994 | (EP) . |
| 657 550 | 6/1995 | (EP) . |
| 2 088 892 A | 6/1982 | (GB) . |
| 59-159944 | 9/1984 | (JP) . |
| 10-219343 | 8/1998 | (JP) . |
| WO 89/01981 | 3/1989 | (WO) . |
| WO 92/12265 | 7/1992 | (WO) . |
| WO 93/06251 | 4/1993 | (WO) . |
| WO 94/19497 | 9/1994 | (WO) . |
| WO 97/17473 | 5/1997 | (WO) . |
| WO 97/20958 | 6/1997 | (WO) . |
| WO 97/23656 | 7/1997 | (WO) . |
| WO 98/27232 | 6/1998 | (WO) . |
| WO 98/27239 | 6/1998 | (WO) . |
| WO 99/16911 | 4/1999 | (WO) . |

* cited by examiner

PRODUCING IRON FROM SOLID IRON CARBIDE

FIELD OF THE INVENTION

The present invention relates to a method of producing iron from iron carbide in a metallurgical vessel containing a bath of molten iron.

SUMMARY OF THE INVENTION

According to the present invention there is provided a method of producing iron from iron carbide which comprises the steps of:

(i) injecting solid iron carbide into a molten bath comprising molten iron and slag and dissolving the iron carbide in the molten bath;

(ii) injecting an oxygen-containing gas into a gas space above the surface of the molten bath to cause combustion of at least a portion of combustible material in the gas space; and (iii) causing splashes and/or droplets of molten iron and/or slag to be ejected upwardly from the molten bath into the gas space above the quiescent bath surface to form a transition zone in which heat generated by combustion of combustible material is transferred to the splashes and/or droplets of molten iron and/or slag and thereafter is transferred to the molten bath when the splashes and/or droplets of molten iron and/or slag return to the molten bath.

The term "combustible material" is understood herein to mean any solid, molten and gaseous material.

By way of example, the term covers carbon monoxide and hydrogen generated in and thereafter released from the molten bath.

The iron carbide may be obtained from any suitable source and be in any suitable form.

Typically, a small proportion of the "iron carbide" comprises iron ore and/or FeO. As a consequence, dissolution of iron carbide in the molten bath in step (i) introduces oxygen into the bath which can combine with dissolved carbon to form carbon monoxide which is released from the bath into the gas space.

In one embodiment, the method comprises injecting an oxygen-containing gas into the molten bath to provide oxygen for reaction with dissolved carbon in the bath to form carbon monoxide which is released from the bath into the gas space.

Step (i) of the above-described method releases carbon into the molten bath. The carbon has the dual purpose of:

(i) maintaining the molten bath as a reducing environment so as to prevent oxidation of the iron in the bath; and (ii) providing a source of combustible material for generating heat to maintain the molten bath at a temperature that is sufficient to dissolve iron carbide injected into the bath.

With regard to sub-paragraph (ii) above, as noted above, there is oxygen in the molten bath—which may be introduced as part of the iron carbide feed and/or injected as part of the oxygen-containing gas in step (ii) of the method—and the oxygen reacts with a proportion of dissolved carbon in the molten bath and is released as carbon monoxide into the gas space above the bath surface.

The carbon monoxide is a combustible material which reacts with oxygen-containing gas in the gas space to form carbon dioxide and, as a consequence of this reaction, generates heat which is transferred via the transition zone to the molten bath.

In addition, a proportion of dissolved carbon reacts with carbon dioxide according to the Bouduard reaction to reform carbon monoxide to generate a further supply of combustible material.

In a similar reaction, a proportion of dissolved carbon reacts with steam to reform carbon monoxide to generate a further supply of combustible material.

The reaction of dissolved carbon and carbon dioxide may take place in the transition zone, with:

(i) dissolved carbon being carried into the transition zone with splashes and/or droplets of molten iron from the molten bath; and (ii) carbon dioxide that is in the gas space being carried into the transition zone with oxygen containing gas injected into the gas space above the molten bath.

It is preferred that the oxygen-containing gas injected into the gas space and/or into the molten bath be air.

It is preferred that the air be pre-heated.

It is preferred particularly that the air be pre-heated to a temperature of at least 550° C.

It is preferred that the method further comprises injecting a carbonaceous material into the molten bath and dissolving the carbonaceous material in the bath.

The term "carbonaceous material" is understood herein to mean any suitable source of carbon, in solid or gaseous form.

By way of example, the carbonaceous material may be coal.

Typically, the coal includes volatiles such as hydrocarbons which are sources of combustible material.

As with the carbon derived from the dissolution of the iron carbide, the carbonaceous material has the dual purpose of:

(i) maintaining the molten bath as a reducing environment so as to prevent oxidation of the iron in the bath; and (ii) providing a source combustible material for generating heat to maintain the molten bath at a temperature that is sufficient to dissolve iron carbide injected into the bath.

It is preferred that the molten bath be maintained at a temperature of at least 1350° C.

It is preferred particularly that the molten bath be maintained at a temperature of at least 1450° C.

In one embodiment it is preferred that the transition zone be formed by injecting a carrier gas and iron carbide and/or the solid carbonaceous material and/or another solid material into the molten bath via a tuyere extending through a side of the vessel that is in contact with the molten bath and/or extending from above the molten bath so that the carrier gas and solid material cause molten iron and slag in the molten bath to be ejected upwardly.

It is preferred particularly that the method comprises controlling injection of carrier gas and solid material to cause molten iron and/or slag to be projected into the space above the molten bath surface in a fountain-like manner.

In another embodiment it is preferred that the transition zone be formed by bottom injection of carrier gas.

In another embodiment it is preferred that the transition zone be formed by bottom injection of a carrier gas and iron carbide and/or solid carbonaceous material and/or other solid material into the molten bath to cause upward eruption of molten iron and slag from the molten bath.

BRIEF DESCRIPTION OF THE DRAWING

The present invention is described further by way of example with reference to the accompanying drawing which is partially schematic/partially sectional view of an apparatus for producing molten iron in accordance with a preferred embodiment of the method of the present invention.

DETAILED DESCRIPTION OF THE INVENTION

Figure 1:
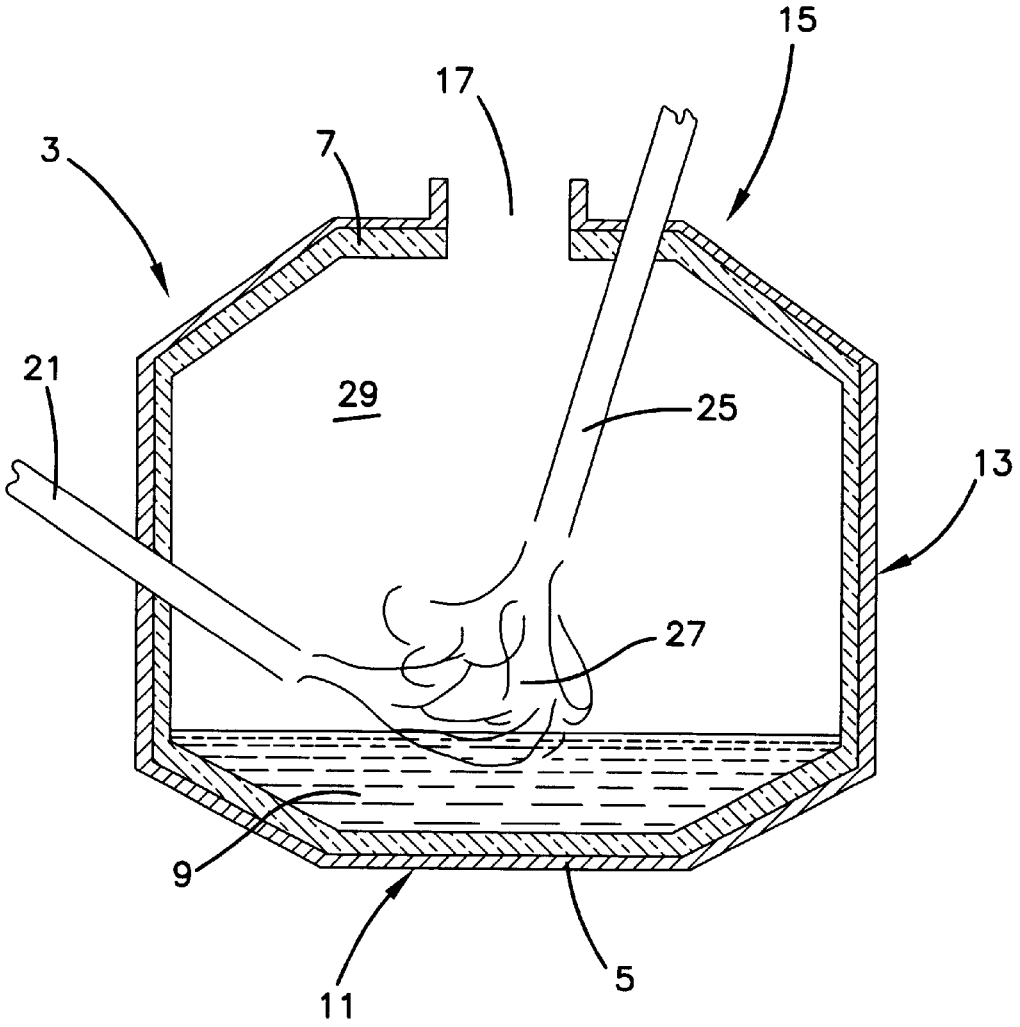

The apparatus shown in the FIGURE comprises a metallurgical vessel 3 having a metal shell 5 and a lining 7 of refractory material which is adapted to contain a bath 9 of molten iron and slag.

The vessel 3 comprises a bottom 11, a side wall 13, a roof 15, and a gas outlet 17.

The apparatus further comprises a single tuyere 21 which is arranged to extend downwardly into the vessel 3 through the side wall 13 to a position at which, in use, the open end of the tuyere 21 is a short distance above the quiescent level of molten iron in the molten bath 9.

The apparatus further comprises a tuyere 25 extending generally vertically into the vessel 3 through the roof 15.

In accordance with a preferred embodiment of the method of the present invention, iron carbide and coal entrained in a suitable carrier gas, such as nitrogen, are injected through the side tuyere 21 into the molten bath 9 of iron and slag.

The iron carbide and coal dissolve in the molten bath 9. The molten iron in the molten bath 9 is tapped periodically or continuously from the vessel 3. In this context, it is noted that the molten iron typically comprises 2–5 wt % carbon.

In accordance with the preferred embodiment of the method of the present invention the iron carbide and coal are injected through the side tuyere 21 with sufficient momentum to cause splashes and droplets of molten iron and slag to be projected upwardly from the molten bath 9 in a fountain-like manner to form a transition zone 27 in the gas space 29 above the molten bath surface.

Furthermore, in accordance with the preferred embodiment of the method of the present invention, a suitable oxygen-containing gas, such as hot air or oxygen-enriched air, is injected via the top tuyere 25 into the gas space 29 toward the transition zone 27. The oxygen-containing gas combusts combustible material, such as carbon monoxide and hydrogen, in the gas space 29, and the initial momentum of the oxygen-containing gas carries the reaction products and heat generated by combustion into the transition zone 27.

An important purpose of the transition zone 27 is to provide an environment for transferring heat generated by combustion in the gas space 29 into the molten bath 9 to maintain the molten bath 9 at a temperature of at lest 1350° C., preferably at least 1450° C. This is achieved by the transfer of heat from combustion of combustible material in the gas space 29 to the droplets and splashes of molten iron and slag in the transition zone 27 and thereafter to the molten bath 9 when the droplets and splashes of molten iron and slag return to the molten bath 9.

The carbon obtained from the dissolution of iron carbide and coal has the dual purpose of maintaining the molten bath 9 as a strongly reducing environment to prevent oxidation of iron in the molten bath 9 and providing a source of heat to maintain the bath 9 in a molten state by:

(i) combusting $CO/H_2$ to $CO_2/H_2O$ in the gas space 29, as described above; and (ii) reforming $CO_2$ to CO to generate further combustible material.

The preferred embodiment of the method of the present invention also comprises injecting suitable slag-forming additives into a molten bath 9.

The above-described method is an effective and efficient means of producing iron from iron carbide.

Many modifications may be made to the preferred embodiment of the method described above in relation to the FIGURE without departing from the spirit and scope of the present invention.

In the claims which follow and in the preceding description of the invention, the words "comprising" and "comprises" are used in the sense of the word "including", is the features referred to in connection with these words may be associated with other features that are not expressly described.

What is claimed is:

1. A method of producing molten iron having a carbon concentration of at least 2 wt % from iron carbide which comprises the steps of:

(i) injecting solid iron carbide into a molten bath comprising molten iron and slag and dissolving the iron carbide in the molten bath and thereby maintaining the molten bath in a reducing environment and generating solid and/or gaseous combustible material, at least some of which is released into a gas space above the surface of the molten bath;

(ii) injecting an oxygen-containing gas into the gas space above the surface of the molten bath and causing combustion of at least a portion of combustible material in the gas space;

(iii) causing splashes and/or droplets of molten iron and/or slag to be ejected upwardly from the molten bath into the gas space above the bath surface to form a transition zone in which heat generated by combustion of combustible material is transferred to the splashes and/or droplets of molten iron and/or slag and thereafter is transferred to the molten bath when the splashes and/or droplets of molten iron and/or slag return to the molten bath; and (iv) periodically or continuously tapping molten iron having a carbon concentration of at least 2 wt %.

2. The method defined in claim 1 wherein the oxygen-containing gas injected into the gas space is air.

3. The method defined in claim 2 comprises preheating the air to a temperature of at least 550° C.

4. The method defined in claim 1 comprises injecting a carbonaceous material into the molten bath and dissolving the carbonaceous material in the bath.

5. The method defined in claim 4 wherein the carbonaceous material is coal.

6. The method defined in claim 1, comprising forming the transition zone by injecting a carrier gas and iron carbide and/or a solid carbonaceous material and/or another solid material into the molten bath via a tuyere extending through a side of a vessel that contains and is in contact with the molten bath and/or extending from above the molten bath so that the carrier gas and solid material cause molten iron and/or slag in the molten bath to be ejected upwardly into the gas space above the molten bath surface.

7. The method defined in claim 6 comprises forming the transition zone by controlling injection of the carrier gas and solid material to cause molten iron and/or slag to be projected into the gas space above the molten bath surface in a fountain-like manner.

8. The method defined in claim 1 comprises forming the transition zone by bottom injection of carrier gas.

9. The method defined in claim 1, comprising forming the transition zone by bottom injection of a carrier gas and iron carbide and/or solid carbonaceous material and/or other solid material into the molten bath to cause upward eruption of molten iron and/or slag from he molten bath into the gas space.

10. The method defined in claim 1, further including the step of injecting an oxygen-containing gas into the molten bath to provide oxygen for reaction with dissolved carbon in the bath to form carbon monoxide which is released from the bath into the gas space.

11. A method of producing molten iron having a carbon concentration of between 2–5 wt % from iron carbide which comprises the steps of:

(i) injecting solid iron carbide into a molten bath comprising molten iron and slag and dissolving the iron carbide in the molten bath and thereby maintaining the molten bath in a reducing environment and generating solid and/or gaseous combustible material, at least some of which is released into a gas space above the surface of the molten bath;

(ii) injecting an oxygen-containing gas into the gas space above the surface of the molten bath and causing combustion of at least a portion of combustible material in the gas space;

(iii) causing splashes and/or droplets of molten iron and/or slag to be ejected upwardly from the molten bath into the gas space above the bath surface to form a transition zone in which heat generated by combustion of combustible material is transferred to the splashes and/or droplets of molten iron and/or slag and thereafter is transferred to the molten bath when the splashes and/or droplets of molten iron and/or slag return to the molten bath; and (iv) periodically or continuously tapping molten iron having a carbon concentration of between 2–5 wt %.

12. The method defined in claim 11, wherein the oxygen-containing gas injected into the gas space is air.

13. The method defined in claim 12, comprising preheating the air to a temperature of at least 550° C.

14. The method defined in claim 11, comprising injecting a carbonaceous material into the molten bath and dissolving the carbonaceous material in the bath.

15. The method defined in claim 14, wherein the carbonaceous material is coal.

16. The method defined in claim 11, comprising forming the transition zone by injecting a carrier gas and iron carbide and/or a solid carbonaceous material and/or another solid material into the molten bath via a tuyere extending through a side of a vessel that contains and is in contact with the molten bath and/or extending from above the molten bath so that the carrier gas and solid material cause molten iron and/or slag in the molten bath to be ejected upwardly into the gas space above the molten bath surface.

17. The method defined in claim 16, comprising forming the transition zone by controlling injection of the carrier gas and solid material to cause molten iron and/or slag to be projected into the gas space above the molten bath surface in a fountain-like manner.

18. The method defined in claim 11, comprising forming the transition zone by bottom injection of carrier gas.

19. The method defined in claim 11, comprising forming the transition zone by bottom injection of a carrier gas and iron carbide and/or solid carbonaceous material and/or other solid material into the molten bath to cause upward eruption of molten iron and/or slag from the molten bath into the gas space.

20. The method defined in claim 11, further including the step of injecting an oxygen-containing gas into the molten bath to provide oxygen for reaction with dissolved carbon in the bath to form carbon monoxide which is released from the bath into the gas space.

* * * * *